US010066904B2

(12) United States Patent
Harings et al.

(10) Patent No.: US 10,066,904 B2
(45) Date of Patent: Sep. 4, 2018

(54) BALLISTIC RESISTANT ARTICLE, SEMI-FINISHED PRODUCT FOR AND METHOD OF MAKING A SHELL FOR A BALLISTIC RESISTANT ARTICLE

(71) Applicant: TEIJIN ARAMID B.V., Arnhem (NL)

(72) Inventors: Jules Harings, Nijmegen (NL); Gerardus Janse, Maasbracht (NL)

(73) Assignee: TEIJIN ARAMID B.V., Arnhem (NL)

( * ) Notice: Subject to any disclaimer, the term of this patent is extended or adjusted under 35 U.S.C. 154(b) by 93 days.

(21) Appl. No.: 14/379,984

(22) PCT Filed: Feb. 18, 2013

(86) PCT No.: PCT/EP2013/053156
§ 371 (c)(1),
(2) Date: Aug. 20, 2014

(87) PCT Pub. No.: WO2013/124233
PCT Pub. Date: Aug. 29, 2013

(65) Prior Publication Data

US 2016/0069649 A1 Mar. 10, 2016

(30) Foreign Application Priority Data

Feb. 20, 2012 (EP) ..... 12156138

(51) Int. Cl.
*F41H 5/02* (2006.01)
*F41H 5/04* (2006.01)
*F41H 1/08* (2006.01)

(52) U.S. Cl.
CPC ..... *F41H 5/0485* (2013.01); *F41H 1/08* (2013.01)

(58) Field of Classification Search
USPC ..... 89/36.02, 36.05, 36.01; 428/98, 221
See application file for complete search history.

(56) References Cited

U.S. PATENT DOCUMENTS 3,582,990 A 6/1971 Frieder
5,112,667 A 5/1992 Li et al.
(Continued)

FOREIGN PATENT DOCUMENTS

CN 1205852 A 1/1999
DE 38 06 204 A1 9/1989
(Continued)

OTHER PUBLICATIONS

International Search Report dated May 29, 2013 issued in International Patent Application No. PCT/EP2013/053156.
(Continued)

*Primary Examiner* — J. Woodrow Eldred
(74) *Attorney, Agent, or Firm* — Oliff PLC

(57) ABSTRACT

Described is a ballistic resistant article, such as a helmet, having a double curved shell in turn has a stack of layers of an oriented anti-ballistic material, the layers having one or more plies and having a plurality of cuts, the ends of which define a central polygon and lobes extending from the polygon. The stack has at least 10 rotationally staggered layers and, for most successive layers, the orientation of the material in the or at least one of the plies is rotationally staggered relative to the orientation of the material in the or at least one of the plies of a successive layer over an angle of 90°±30°.

18 Claims, 6 Drawing Sheets

(56) References Cited

U.S. PATENT DOCUMENTS

| | | | | |
|---|---|---|---|---|
| 8,887,312 | B2 * | 11/2014 | Bhatnagar | A42B 3/063 2/2.5 |
| 2005/0125881 | A1 | 6/2005 | Cheese | |
| 2011/0023202 | A1 | 2/2011 | Vanarsdalen et al. | |
| 2011/0159233 | A1 | 6/2011 | Marissen et al. | |
| 2011/0227247 | A1 | 9/2011 | Meijer et al. | |
| 2017/0057200 | A1 * | 3/2017 | Von Hess | F41H 5/0485 |

FOREIGN PATENT DOCUMENTS

| | | | |
|---|---|---|---|
| EP | 0 585 793 | A1 | 3/1994 |
| EP | 0 833 742 | | 9/2002 |
| GB | 2 196 833 | A | 5/1998 |
| WO | WO 91/12136 | | 8/1991 |
| WO | WO 03/074962 | | 9/2003 |
| WO | WO 2009/047795 | | 4/2009 |
| WO | WO 2009/109632 | | 9/2009 |

OTHER PUBLICATIONS

Written Opinion dated May 29, 2013 issued in International Patent Application No. PCT/EP2013/053156.

* cited by examiner

BALLISTIC RESISTANT ARTICLE, SEMI-FINISHED PRODUCT FOR AND METHOD OF MAKING A SHELL FOR A BALLISTIC RESISTANT ARTICLE

BACKGROUND

Described herein is a ballistic resistant article, such as a helmet, comprising a double curved shell in turn comprising a stack of layers of an oriented anti-ballistic material, the layers comprising one or more plies each and having a plurality of cuts, the ends of which define a central polygon and lobes extending from the polygon, and wherein the stack comprises rotationally staggered layers, typically rotated about an axis extending through the centre of the polygon. The embodiments further relate to a semi-finished product for and method of making a shell for a ballistic resistant article.

Conventionally, ballistic resistant double curved articles, such as helmets, are manufactured using pattern moulding technology or draw/thermo forming technology. Both processes result in a shell of stacked layers that consist of anti-ballistic fibres embedded in a polymer matrix (~15-25% w/w). Subsequently, the stack is consolidated by compression moulding and the polymeric matrix, for example a curing thermoset, e.g. phenolic resin, or a thermoplast, fuses into a unified entity. Due to matrix fusion, high matrix content and small fibre and ply dimensions, irregularities such as folding, overlap and gaps, the latter introduced by pattern cuts to facilitate adequate drapability, level off. Draw forming, described in US 2011/0159233, reduces the formation of irregularities when compared to pattern moulding, but is only feasible with reinforcing elements that can be drawn substantially at temperatures well below the melting temperature. Both technologies are successfully applied using ultra high molecular weight polyethylene (UHMWPE) fibres.

Recent advances in the development of high strength and high modulus tapes, using for example UHMWPE, led to unidirectional plies (also referred to as "UDs"), cross-plies (also referred to as "X-plies"), and tape fabrics of exceptional anti-ballistic performance, inter alfa arising from the low matrix (glue) content (<8% w/w) required to consolidate the stack of layers. However, the geometrically induced stiffness of UHMWPE tapes, especially on UD, cross-ply and fabric level, entails uncontrollable wrinkling of plies and tapes once draped in or around double curved objects. During moulding, the reinforcing elements, which are generally of larger dimensions than fibres, are constrained on large length scales. As a consequence, irregularities, which may also arise in draw forming, persist upon moulding and lead eventually to lower, uncontrollably inhomogeneous anti-ballistic performance. Moreover, the molecular architecture of most tapes hampers draw forming at temperatures well below the melting temperature.

EP 585 793 relates to a penetration resistant article, e.g. a helmet, comprising a plurality of prepreg packets each comprising at least two prepreg layers wherein said layers are comprised of a fibrous network in a polymeric matrix wherein said prepreg layers have been precompressed into prepreg packets at a temperature and pressure sufficient to bond adjacent surfaces of adjacent layers.

WO 03/074962 relates to a method of making a helmet comprising the steps of cutting a plurality of substantially rectangular, preferably square, blanks from a sheet of resin-impregnated fabric, making curved cuts (denoted by numeral 1 in the Figures of WO 03/074962) in each blank to form a crown portion (5) and lobe portions (3) therefrom, arranging a stack of said sheets into a helmet preform such that the lobe portions of any blank partially overlap adjacent lobe portions of the same blank, and molding the helmet from the preform.

U.S. Pat. No. 3,582,990 relates to a ballistic cover for a protective helmet in which an envelope of relatively light fabric cut and sewed to the shape of the helmet receives an assembly of a plurality of laminates of woven ballistic fabric individually cut and sewed to the shape of the helmet and tacked together around their peripheries with their seams out of line to form the assembly.

WO 2009/047795 relates to a bolt-free helmet comprising a plurality of helmet pre-forms. At least one outer pre-form of the plurality of pre-forms comprises a plurality of slots.

US 2011/0023202 relates to a method of manufacturing a composite laminate comprising the steps of cutting a plurality of ply shapes from prepreg sheet stock and stacking the prepreg ply shapes to form a subassembly of from 2 to 8 cut plies. The subassembly further comprising at least 2 different ply shapes.

GE 2 196 833 relates to a method of making a ballistic helmet in which each of the plies making up the body is formed from a hexagonal blank cut from a ballistic cloth and provided with slits extending from the apices thereof toward the centre to form a central area and segments extending from the central area.

U.S. Pat. No. 5,112,667 relates to an impact resistant helmet, comprising an impact resistant composite shell. The composite shell comprises a plurality of prepreg packets. Each prepreg packet comprises at least about 2 and preferably 5 to 20 prepreg layers. There are from 2 to 50 and preferably 5 to 20 prepreg packets. Each prepreg layer comprises a plurality of unidirectional coplanar fibers embedded in a polymeric matrix. The fibers of adjacent layers in the prepreg packets are at an angle of from 45° to 90°, most preferably about 90° from each other. The prepreg packets are initially flat and are cut into patterns to enable the prepreg packet to be formed into the shape of the shell. The pattern is cut so that upon being formed into the shape of the shell the prepreg packets have substantially no wrinkles. The prepreg packets have cuts or edges which are built in to the shell. The edges substantially come together to form a seam when the packet is formed into the shape of the three-dimensional shell. Adjacent packets formed into the shell have meridial cuts made at different locations on the pattern to avoid overlapping of the seams of adjacent patterns.

BRIEF SUMMARY

It is an object of the present embodiments to provide an improved ballistic resistant article.

To this end, the stack comprises at least 10 rotationally staggered layers, i.e. at least 10 layers are at a corresponding number of staggered (different) rotational positions, and, for most successive layers, the orientation of the material, typically corresponding to the orientations of fibres or tapes in the (plies in the) layers, in the or at least one of the plies is rotationally staggered relative to the orientation of the material in the or at least one of the plies of a successive layer over an angle ($\alpha 1$) of 90°±30°, i.e. said orientations are at a mutual angle in a range from 60° to 120°, preferably 90°±20°, preferably 90°±10°.

In an embodiment, the angle ($\alpha 2$) between the layers is smaller than 20°, preferably smaller than 10°, and preferably equals $$((P\times 360°)/(N\times M))\pm 30\%, \text{ preferably } \pm 20\%, \text{ preferably } \pm 10\%$$

where P is an integer, N is the number of layers and M is the number of cuts in individual layers.

It was found that the combination of angles of 90°±30° between the orientations of the material in successive layers and an even distribution of cuts over the circumference of the shell enables maintaining to a large extend the ballistic properties, in particular $SEA_{50}$, of a two dimensional stack when converting the stack to a three dimensional shell. I.e., the anti-ballistic properties of the shell are close to and may even exceed those of a plate made from an identical stack under identical conditions.

In an embodiment, at least 70%, preferably at least 80%, more preferably at least 90%, preferably 95% of successive layers are rotationally staggered relative to each other over said angle ($\alpha 2$) and are preferably concentrated at the side of the strike-face.

In an embodiment, the angle ($\alpha 2$) is the same, e.g. a constant 2° or 4°, between most of the layers and preferably between at least 10 successive layers.

In an example, the stack comprises, counting from the strike-face, 15 successive layers rotationally staggered relative to each other over said angle $\alpha 2$, 5 layers staggered over an angle larger than 20°, e.g. to enhance adhesion between the substacks of layers, a further 15 successive layers rotationally staggered relative to each other over said angle $\alpha 2$, and a further 5 layers staggered over an angle larger than 20°, yielding a 15-5-15-5 configuration of the stack counting from the strike-face. Other examples include substacks of 35 (successive; <20° and 5 (>20°), 30-10, 20-10-20, 10-5-10-5-10, et cetera.

In an embodiment, P equals 1, 2, 3 or 4. I.e., the numerator in the equation for angle $\alpha 2$ preferably equals approximately 360°, 720°, 1080°, or 1440° respectively. Small numerators, of e.g. 360°, enable small rotational angles between the orientations in successive layers and are thus preferred.

In another embodiment, the stack comprises at least 20 layers, preferably at least 30 layers, preferably at least 40 layers. In a further embodiment, the layers have a thickness in a range from 10 to 300 microns, preferably in a range from 20 to 220 microns.

By reducing P and/or increasing the number of layers (N), which increase is facilitated by reducing the thickness of individual layers, the angle ($\alpha 2$) between successive layers or patterns can be chosen smaller and deviations from 0°-90° transitions between the orientations of successive layers can be kept similarly small. I.e., given the number of layers, the stack and a double curved shell made from it better approach a 0°-90°-0°-90° (recurring) configuration, which, within the framework of the present embodiments, is considered optimal.

In another embodiment, in regions where a lobe overlaps a cut and thus a small portion of a lob in an adjacent layer, a matrix, e.g. an adhesive or a polymer, in particular a polymer film or inlay, is applied between the adjacent lobes and preferably through the cut.

It is preferred that the matrix is or contains a thermoplastic polymer having a softening temperature below the consolidation temperature of the stack. Suitable examples of the polymer include polyolefins, such as LLDPE, LDPE and HDPE, preferably in the form of a film or inlay, e.g. having a thickness in a range from 1 to 200 μm, preferably in a range from 4 to 100 μm, preferably in a range from 20 to 60 μm. In an embodiment, the film or inlay extends through at least 10 cuts and over at least 10 regions of overlapping lobs in adjacent layers. In an embodiment, the film(s) or inlay(s) is (are) positioned in the stack by lifting a lob of a lowermost layer in the stack, thus lifting a 'fan' of lobes and revealing a 'stairs' of non-lifted lobes, laying the film or inlay onto the non-lifted lobes and lowering the lifted lobes. In an embodiment, the length of the strip is defined by the substantially horizontal pathway of the lobes along their rotational order (i.e., parallel to the rim). The width of the strip extends perpendicular to the rim and in case of four lobes parallel to the incisions. In other words, the length is defined by the path of a particular incision throughout the rotationally staggered stack. The width is defined by the length of the incisions. The shape may be rectangular, but for even material distribution is preferably a section of an unfolded cone. The upper and lower curvature are defined by the trajectories of the ends and beginnings of the incisions through the stack.

The matrix, e.g. a polymer film or inlay, increases adhesion between the layers and reduces or prevents voids, i.e. it provides improved integrity of the helmet, especially when the processing temperature during the molding of the helmet is above the softening point of the polymer film or inlay. It is preferred that the softening temperature of the polymer is at least 80° C.

In another embodiment, the orientation of the material relative to the pattern, typically defined by the cuts or circumference, of the layers is substantially identical in most preferably all layers. In consequence, adjoining lobes in successive layers are rotationally staggered relative to each other over the same angle $\alpha$ as the orientations, simplifying the design of the shell.

In another embodiment, the orientation of the material relative to the pattern of the layers varies in most preferably all layers. E.g., when cutting the layers from a sheet, the cutting pattern is successively rotated over a suitable angle with respect to the fibre or tape orientation of the layers and the layers are subsequently stacked without staggering of with limited staggering. I.e., staggering of the orientation of the material and staggering of the layers are effectively decoupled.

In an embodiment, e.g. if the patterns of the layers and/or the position of the cuts vary between most or all layers, the central polygons serve as a reference for the rotationally staggering of the layers.

Further, it should be noted that dependent on fibre or tape orientation and position in a layer symmetrical patterns can be rotated over an angle ($\alpha+(Q\times 180°)$) for UD-based layers and ($\alpha+(Q\times 90°)$) for fabrics, where Q is an integer, to achieve identical stacks. Put differently, the tape orientation in UD-based X-plies and fabrics is identical after rotation over ($Q\times 180°$) and ($Q\times 90°$ respectively.

In another embodiment, the cuts in or along the lobes to reduce irregularities in the lobes define secondary fold lines that, in order to minimize tape or fiber orientation deviations in successive layers, are preferably positioned parallel or perpendicular to the edge of the central polygon where the respective lobe and the central polygon connect. These edges (sides) of the polygon form the primary fold lines that direct ply deposition e.g. when the stack is placed in a concave mould.

It is generally preferred that the polygon is a convex polygon, i.e. every internal angle is less than or equal to 180° and every line segment between two vertices remains inside or on the boundary of the polygon.

In an embodiment, the polygon is defined by four cuts (M=4) in individual layers and preferably is a rectangle, e.g. a square. In a further embodiment, most preferably all of the layers comprise four lobes and the orientations of the material in neighbouring lobes, when considered in the two dimensional (flat) state of the layer, are rotated relative to each other, preferably about an angle of 90°. Thus, in regions where a lobe overlaps a cut in a layer directly below or above, the variation in orientation with that layer is relatively small, i.e. the stack at these locations better approaches the 0°-90°-0°-90° (recurring) configuration. Further, especially when relatively stiff layers are used in the stack, with four cuts positioning (draping) of the stack in a concave mould is still straightforward and the total number of cuts remains low.

In another embodiment, the polygon is provided, at or near the ends of the cuts, with openings or cutouts, e.g. in the shape of a sickle. It was found that in some configurations, wrinkles are induced in the polygon when the stack is draped in or around double curved objects. The openings or cutouts prevent or reduce such wrinkles. It is preferred that the openings or cutouts are dimensioned to remove sufficient material to prevent wrinkling and yet avoid the presence of openings in the polygon after the stack is draped in or around a double curved object.

Due to the ellipsoidal shape of most helmets, a pattern that offers perfect coverage on a specific rotational position may fail in covering the double curved surface neatly after rotation. This typically results in irregularities such as wrinkles and gaps. To prevent such irregularities, in an embodiment, the patterns of most, preferably all, layers are corrected for the rotational position on that surface. Such corrections yield a configuration where adjacent lobes differ significantly in shape but upon rotation align with the shape of the neighboring lobe in the rotation direction.

In analogy, the increase in cross-sectional radii of the helmet resulting from the addition of layers leads to imperfect coverage of the shell if the dimensions are not adapted accordingly. Hence, in another embodiment, the dimensions of the patterns of most, preferably all, layers are adapted to their position in the stack and the corresponding radii, e.g., in case of a helmet, the dimensions of the patterns increase towards the strike-face.

In a preferred embodiment, the layers comprise a ply, cross-ply or fabric of unidirectional polymer sheets, or unidirectional polymer elongated bodies.

DETAILED DESCRIPTION

Figure 1:
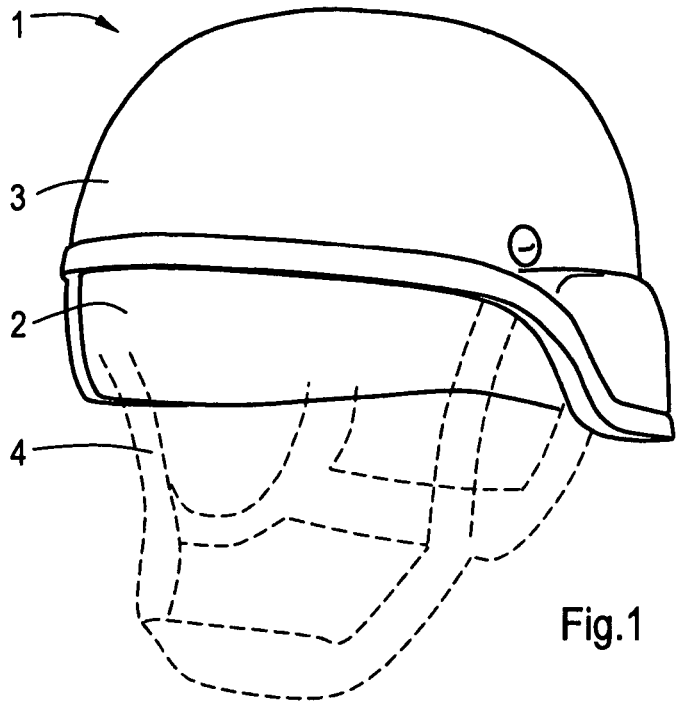
FIG. 1 is a perspective view of a combat helmet according to the present embodiments.

Within the context of the present embodiments the term "elongated body" means an object the largest dimension of which, the length, is larger than the second smallest dimension, the width, and the smallest dimension, the thickness. More in particular, the ratio between the length and the width generally is at least 10. The maximum ratio is not critical to the present embodiments and will depend on processing parameters. As a general value, a maximum length to width ratio of 1 000 000 may be mentioned. Accordingly, the elongated bodies used in the present embodiments encompass monofilaments, multifilament yarns, threads, tapes, strips, staple fibre yarns and other elongated objects having a regular or irregular cross-section.

Within the framework of the present embodiments, the term "layer" comprises both single plies, also known as UDs or monolayers, and a plurality of adjoining plies occupying the same rotational position in the stack, irrespective of whether the plies are consolidated or not. The term "most" is defined as at least 50%, preferably at least 60%, preferably at least 70%, preferably at least 80%, preferably at least 90%, preferably 95%.

In an embodiment the plies have a thickness in the range of 5-500 microns, preferably 10-300 microns, more preferably 20-220 microns.

In an embodiment, the tapes in the plies have a thickness in a range from 5 to 100 microns, preferably in a range from 10 to 75 microns, and a width in a range from 1 to 200 millimeters, preferably in a range from 2 to 150 millimeters.

In an embodiment, the plies comprise reinforcing tapes of fibers arranged in parallel. The tapes may be bonded together, e.g., using a matrix material or through other means such as using a bonding thread, or through consolidation of adjacent tapes at a location of overlap, e.g., using heat and pressure.

In one embodiment a ply comprises a first tapelayer of tapes arranged in parallel, and a second tapelayer of tapes arranged on top of the first tapelayer of tapes, wherein the tapes in the second tapelayer are arranged parallel to the tapes in the first tapelayer but offset thereto. This configuration is often referred to as "brick" plies. If so desired, further tapelayers of tapes may be added, wherein the tapes in the further tapelayer are arranged parallel to the tapes in the first tapelayer but offset to the tapelayer on which they are arranged.

The various tape (tape) layers may be consolidated by application of a matrix material between the layers, e.g. in solution form, dispersion form, molten form or solid form. The individual layers in the brick may also be consolidated through other means, e.g. using bonding thread or using heat and/or pressure to bond the layers together.

In another embodiment, the tapes in the first ply are arranged in parallel and the tapes in the second ply are arranged perpendicular to the tapes in the first ply, yielding a so-called cross-ply (X-ply). Crossply's may also be made from bricklayered tapelayers as discussed above. In another embodiment the tapes or fibers are woven into a fabric where warp and weft tapes or fibers are at a mutual angle of 90°. In such fabrics, the matrix, if present, can be applied as a solid, solution, dispersion or melt and prior to or after weaving.

It is preferred that the stack of layers in the article according to the present embodiment contains 0 to 8 wt % of matrix material, preferably 0.5 to 4 wt %. The low matrix content of the stack in the ballistic resistant article of the present embodiment allows the provision of a highly ballistic resistant low weight material.

The reinforcing elements, i.e. tapes or fibers, have a high tensile strength, a high tensile modulus and a high energy absorption, reflected in a high energy to break. It is preferred that the reinforcing elements have a tensile strength of at least 1.0 GPa, a tensile modulus of at least 40 GPa, and a tensile energy to break of at least 15 J/g.

In one embodiment, the tensile strength of the reinforcing elements is at least 1.2 GPa, more in particular at least 1.5 GPa, more in particular at least 1.8 GPa, more in particular at least 2.0 GPa. In a particularly preferred embodiment, the tensile strength is at least 2.5 GPa, more in particular at least 3.0 GPa, more in particular at least 4 GPa.

In another embodiment, the reinforcing elements have a tensile modulus of at least 50 GPa. More in particular, the reinforcing elements may have a tensile modulus of at least 80 GPa, more in particular at least 100 GPa. In a preferred embodiment, the reinforcing elements have a tensile modulus of at least 120 GPa, more in particular at least 140 GPa, or at least 150 GPa.

Tensile strength and modulus are determined in accordance with ASTM D882-00.

In another embodiment, the reinforcing elements have a tensile energy to break of at least 20 J/g, in particular at least 25 J/g. In a preferred embodiment the reinforcing elements have a tensile energy to break of at least 30 J/g, in particular at least 35 J/g, more in particular at least 40 J/g, still more in particular at least 50 J/g. The tensile energy to break is determined in accordance with ASTM D882-00 using a strain rate of 50%/min. It is calculated by integrating the energy per unit mass under the stress-strain curve.

Suitable inorganic elongated bodies having a high tensile strength are for example glass fibres, carbon fibres, and ceramic fibres.

Suitable organic tapes or fibers having a high tensile strength are for example tapes or fibers made of aramid, of melt processable liquid crystalline polymer, and of highly oriented polymers such as polyolefins, polyvinylalcohol, and polyacrylonitrile. In the present embodiment, the use of polyolefin tapes or aramid tapes is preferred.

It is preferred for the tapes used in the present embodiment to be high-drawn tapes of high-molecular weight linear polyethylene. High molecular weight here means a weight average molecular weight of at least 400,000 g/mol. Linear polyethylene here means polyethylene having fewer than 1 side chain per 100 C atoms, preferably fewer than 1 side chain per 300 C atoms. The polyethylene may also contain up to 5 mol % of one or more other alkenes which are copolymerisable therewith, such as propylene, butene, pentene, 4-methylpentene, octene. It is particularly preferred to use tapes of ultrahigh molecular weight polyethylene (UHMWPE), that is, polyethylene with a weight average molecular weight of at least 500,000 g/mol. The use of tapes with a weight average molecular weight of at least $1\times10^6$ g/mol may be particularly preferred. The maximum molecular weight of the UHMWPE tapes suitable for use in the present embodiment is not critical. As a general value a maximum value of $1\times10^8$ g/mol may be mentioned. The molecular weight distribution and molecular weight averages (Mw, Mn, Mz) are determined in accordance with ASTM D 6474-99 at a temperature of 160° C. using 1,2,4-trichlorobenzene (TCB) as solvent. Appropriate chromatographic equipment (PL-GPC220 from Polymer Laboratories) including a high temperature sample preparation device (PL-SP260) may be used. The system is calibrated using sixteen polystyrene standards (Mw/Mn<1.1) in the molecular weight range $5\times10^3$ to $8\times10^6$ g/mole.

In a preferred embodiment, polyethylene tapes are used which combine a high molecular weight and a high molecular orientation as is evidenced by their XRD diffraction pattern.

In one embodiment, the polyethylene reinforcing elements are tapes having a 200/110 uniplanar orientation parameter Φ of at least 3. The 200/110 uniplanar orientation parameter Φ is defined as the ratio between the 200 and the 110 peak areas in the X-ray diffraction (XRD) pattern of the tape sample as determined in reflection geometry. Wide angle X-ray scattering (WAXS) is a technique that provides information on the crystalline structure of matter. The technique specifically refers to the analysis of Bragg peaks scattered at wide angles. Bragg peaks result from long-range structural order. A WAXS measurement produces a diffraction pattern, i.e., intensity as function of the diffraction angle 2θ (this is the angle between the diffracted beam and the primary beam). The 200/110 uniplanar orientation parameter gives information about the extent of orientation of the 200 and 110 crystal planes with respect to the tape surface. For a tape sample with a high 200/110 uniplanar orientation, the 200 crystal planes are highly oriented parallel to the tape surface. It has been found that a high uniplanar orientation is generally accompanied by a high tensile strength and high tensile energy to break. The ratio between the 200 and 110 peak areas for a specimen with randomly oriented crystallites is around 0.4. However, in the tapes that are preferentially used in one embodiment, the crystallites with indices 200 are preferentially oriented parallel to the film surface, resulting in a higher value of the 200/110 peak area ratio and therefore in a higher value of the uniplanar orientation parameter. The ultra-high-molecular-weight polyethylene (UHMWPE) tapes used in one embodiment of the ballistic material have a 200/110 uniplanar orientation parameter of at least 3. It may be preferred for this value to be at least 4, more in particular at least 5, or at least 7. Higher values, such as values of at least 10 or even at least 15 may be particularly preferred. The theoretical maximum value for this parameter is infinite if the peak area 110 equals zero. High values for the 200/110 uniplanar orientation parameter are often accompanied by high values for the strength and the energy to break. For a determination method of this parameter reference is made to WO2009/109632.

In one embodiment, the UHMWPE tapes, in particular UHMWPE tapes with an Mw/MN ratio of at most 6 have a DSC crystallinity of at least 74%, more in particular at least 80%. The DSC crystallinity can be determined as follows using differential scanning calorimetry (DSC), for example on a Perkin Elmer DSC7. Thus, a sample of known weight (2 mg) is heated from 30 to 180° C. at 10° C. per minute, held at 180° C. for 5 minutes, then cooled at 10° C. per minute. The results of the DSC scan may be plotted as a graph of heat flow (mW or mJ/s; y-axis) against temperature (x-axis). The crystallinity is measured using the data from the heating portion of the scan. An enthalpy of fusion ΔH (in J/g) for the crystalline melt transition is calculated by determining the area under the graph from the temperature determined just below the start of the main melt transition (endotherm) to the temperature just above the point where fusion is observed to be completed. The calculated ΔH is then compared to the theoretical enthalpy of fusion (ΔHc of 293 J/g) determined for 100% crystalline PE at a melt temperature of approximately 140° C. A DSC crystallinity index is expressed as the percentage 100(ΔH/ΔHc). In one embodiment, the tapes have a DSC crystallinity of at least 85%, more in particular at least 90%.

In general, the polyethylene reinforcing elements, have a polymer solvent content of less than 0.05 wt. %, in particular less than 0.025 wt. %, more in particular less than 0.01 wt. %.

In one embodiment, the polyethylene tapes may have a high strength in combination with a high linear density. In the present application, the linear density is expressed in dtex. This is the weight in grams of 10,000 meters of film. In one embodiment, the film has a linear density of at least 3000 dtex, in particular at least 5000 dtex, more in particular at least 10000 dtex, even more in particular at least 15000 dtex, or even at least 20000 dtex, in combination with strengths of, as specified above, at least 2.0 GPa, in particular at least 2.5 GPa, more in particular at least 3.0 GPa, still more in particular at least 3.5 GPa, and even more in particular at least 4.

Within the context of the present specification the word aramid refers to linear macromolecules made up of aromatic groups, wherein at least 60% of the aromatic groups are joined by amide, imide, imidazole, oxalzole or thiazole linkages and at least 85% of the amide, imide, imidazole, oxazole or thiazole linkages are joined directly to two aromatic rings with the number of imide, imidazole, oxazole or thiazole linkages not exceeding the number of amide linkages.

In a preferred embodiment, at least 80% of the aromatic groups are joined by amide linkages, more preferably a least 90%, still more preferably at least 95%.

In one embodiment, of the amide linkages, at least 40% are present at the para-position of the aromatic ring, preferably at least 60%, more preferably at least 80%, still more preferably at least 90%. Preferably, the aramid is a para-aramid, that is, an aramid wherein essentially all amide linkages are adhered to the para-position of the aromatic ring.

In one embodiment, the aramid is an aromatic polyamide consisting essentially of 100 mole % of:

A. at least 5 mole % but less than 35 mole %, based on the entire units of the polyamide, of units of formula (1)

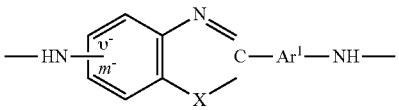

wherein $Ar^1$ is a divalent aromatic ring whose chain-extending bonds are coaxial or parallel and is a phenylene, biphenylene, naphthylene or pyridylene, each of which may have a substituent which is a lower alkyl, lower alkoxy, halogen, nitro, or cyano group, X is a member selected from the group consisting of O, S and NH, and the NH group bonded to the benzene ring of the above benzoxazle, benzothiazole or benzimidazole ring is meta or para to the carbon atom to which X is bonded of said benzene ring;

B. 0 to 45 mole %, based on the entire units of the polyamide, of units of formula (2)

$$—NH—Ar^2—NH—$$

wherein $Ar^2$ is the same in definition as $Ar^1$, and is identical to or different from $Ar^1$, or is a compound of formula (3)

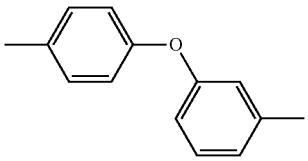

C. an equimolar amount, based on the total moles of the units of formulae (1) and (2) above, of a structural unit of formula (4)

$$—CO—Ar^3—CO—$$

wherein $Ar^3$ is

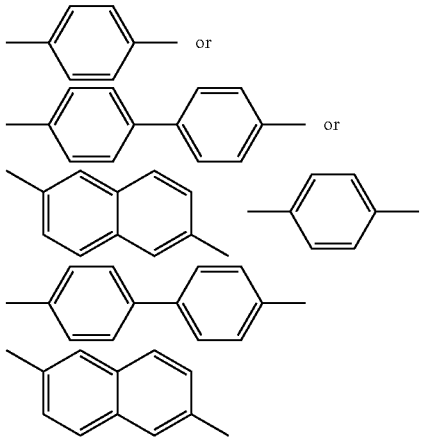

in which the ring structure optionally contains a substituent selected from the group consisting of halogen, lower alkyl, lower alkoxy, nitro and cyano; and D. 0 to 90 mole %, based on the entire units of the polyamide, of a structural unit of formula (5) below $$—NH—Ar^4—CO—$$

wherein $Ar^4$ is the same in definition as $Ar^1$, and is identical to or different from $Ar^1$.

The preferred aramid is poly(p-phenylene terephthalamide) which is known as PPTA. PPTA is the homopolymer resulting from mole-for-mole polymerization of p-phenylenediamine and terephthaloyl chloride. Another preferred aramid are co-polymers resulting from incorporation of other diamines or diacid chlorides replacing p-phenylenediamine and terephthaloyl chloride respectively.

Aramid tapes can be made by spreading aramid yarns that are subsequently embedded in a polymer matrix or preferably be directly spun from solution as for example described in US 2011/0227247 A1.

The matrix material, when present, preferably wholly or partially consists of or comprises a polymer material, which optionally can contain fillers usually employed for polymers. The polymer may be a thermoset or thermoplastic or a mixture of both. Preferably a soft plastic is used, in particular it is preferred for the matrix material to have a tensile modulus (at 25° C.) of between 200 and 1400 MPa, in particular between 400 and 1200 MPa, more in particular between 600 and 1000 MPa. The use of non-polymeric organic matrix material is also envisaged. The purpose of the matrix material is to adhere the tapes and/or the plies together where required. Any matrix material which achieves this result is suitable as matrix material.

It is preferred that the elongation at break of the matrix material is greater than the elongation at break of the reinforcing tapes. The elongation at break of the matrix preferably is in a range from 3 to 1200%. These values apply to the matrix material in the final ballistic resistant article. Examples of suitable thermosets and thermoplastics are listed in i.a. EP 833 742 and WO-A-91/12136. Vinylesters, unsaturated polyesters, epoxides or phenol resins are currently preferred as matrix material from the group of thermosetting polymers. These thermosets usually are in the layer in partially set condition (the so-called B stage) before the stack of layers is cured during compression of the ballistic-resistant moulded article. Thermoplastic polymers that are suitable for the reinforcing elements are listed in for instance EP 833 742 and WO-A-91/12136. In particular, the thermoplastic polymers may be selected from at least one of polyurethanes, polyvinyls, polyacrylates, polyolefins and block copolymers such as SIS (styrene-isoprene-styrene), SBS (styrene-butadiene-styrene), SEBS (styrene-ethylene-butylene-polystyrene). Polyolefins and block copolymers are preferably chosen as matrix material.

The embodiments further relate to a semi-finished product for making a shell, comprising a non-consolidated stack of layers as described above. In an embodiment, the stack of layers is held together and rotationally fixed by fastening means, e.g. by a weld or a series of welds, glue, one or more rivets, or a stitched pattern, preferably arranged in a triangle or triangular in shape, extending through the central polygons. Thus, misalignment of the layers when placing the stack in a mold is reduced or avoided. Also, the stack can be made with the layers properly aligned at a first location and subsequently transported to and molded at a second location while maintaining initial alignment.

The present application also relates to a method of manufacturing a double curved ballistic resistant article, such as a helmet, comprising the steps of placing a stack of layers of an anti-ballistic material as described above in a concave mould and consolidating the stack by applying pressure or elevated temperature and pressure.

The pressure is preferably at least 0.5 MPa and typically should not exceed 50 MPa. Where necessary, the temperature during compression is selected such that the matrix material is brought above its softening or melting point, if this is necessary to cause the matrix to help adhere the tapes, plies and/or layers to each other. Compression at an elevated temperature is intended to mean that the moulded article is subjected to the given pressure for a particular compression time at a compression temperature above the softening or melting point of the organic matrix material and below the softening or melting point of the tapes. The required compression time and compression temperature depend on the nature of the tape and matrix material and on the thickness of the moulded article and can be readily determined by the person skilled in the art.

The embodiments will now be explained with reference to a preferred embodiment shown in the Figures.

FIG. 1 shows a combat helmet 1 according to an embodiment comprising a shell 2 provided with external coatings 3 known in themselves, a pad suspension system (hidden from view), optionally a helmet cover (not shown) and a chinstrap 4.

Figure 2:
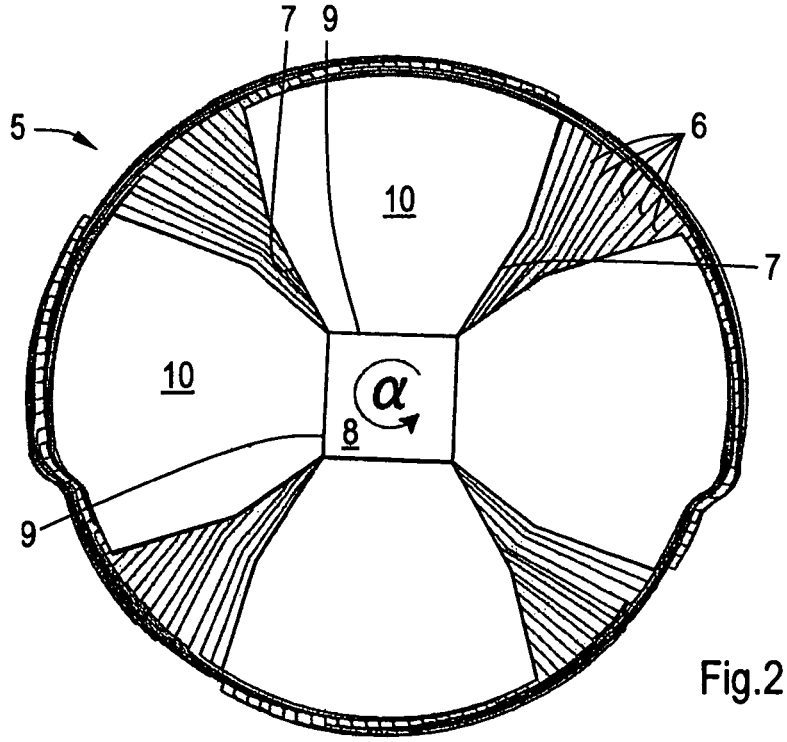
FIG. 2 is a bottom view of a semi-finished product for making the helmet shown in FIG. 1.

In this example, the shell 2 was made from a semi-finished product, shown in FIG. 2, comprising a stack 5 of 40 layers 6 of an oriented anti-ballistic material, e.g. Endumax® consolidated in 0-90° cross-plies. I.e., each layer comprises two plies of parallel tapes and the plies in the layer are at a mutual angle of 90°. The stack comprises (40×2=) 80 plies.

Figure 3:
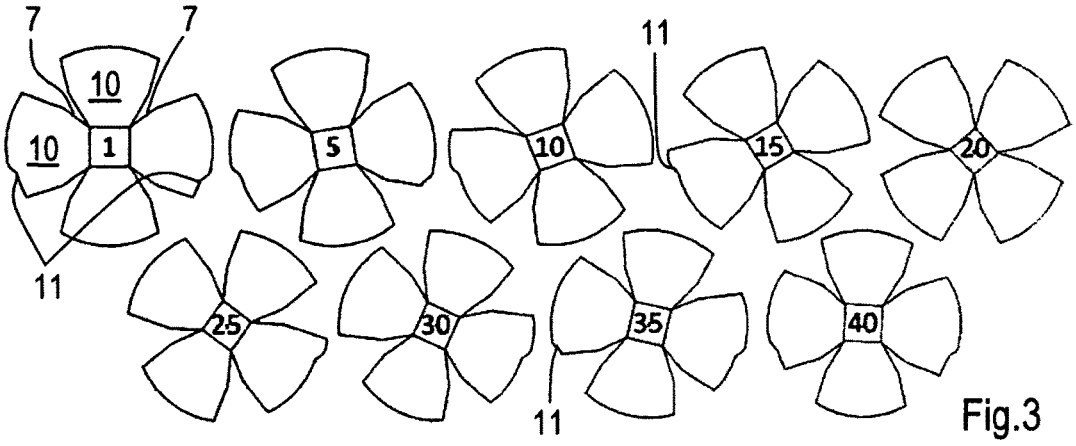
FIG. 3 is a plan view of nine X-plies contained in the semi-finished product shown in FIG. 2.

Each of the layers 6 has four cuts 7, best shown in FIG. 3, the ends of which define a central polygon or crown, in this example a square 8 providing four primary fold lines 9, and four lobes 10 extending from the polygon 8. The orientations of the tapes are identical in all layers and extend parallel to the fold lines, i.e. the tapes in one of the plies extend parallel to a first pair of parallel fold lines and the tapes in the other ply extend parallel to the second pair of fold lines and perpendicular to the first pair.

To further reduce or minimize orientation deviations in successive layers, the layers, and thus the tapes in the layers, are rotationally staggered relative to each other over an angle $\alpha 2$ of $$((1\times 360°)/40\times 4)=2.25°.$$

FIG. 3 shows nine individual layers of the stack, the top layer (with a "1" in it's central polygon) and eight subsequent layers deeper in the stack and rotated, in this example counter-clockwise when viewed from the top, over 9°, 20°, 32°, 43°, 54°, 65°, 77°, 88°, respectively.

The lower rim of helmet roughly follows the eyes (free), ears and neck (covered) of the intended wearer. This is reflected in the pattern of the layers, i.e. the front lobe in the top layer is shorter than the rear lobe and the side lobes are provided with appropriate cut-outs 11. These features 'rotate' in a direction opposite to that of $\alpha 2$, such that they align in the stack.

To reduce irregularities even further the pattern dimensions are corrected for their position in the stack and the rotational position on the eventual spherical shell. From FIG. 2 it is evident that from the bottom layer to the top layer the size of the patterns gradually increases to compensate for the continuously increasing thickness (radii) of the helmet. Neglecting the rim corrections mentioned above, the ellipsoidal corrections are reflected in the varying lobe dimensions of adjacent lobes in a single pattern (FIG. 3). Note that the dimensional differences between adjacent lobes in a single layer are the biggest in pattern 1 and 40, and the smallest in pattern 20 where dimensions of adjacent lobes are nearly identical.

Figure 4:
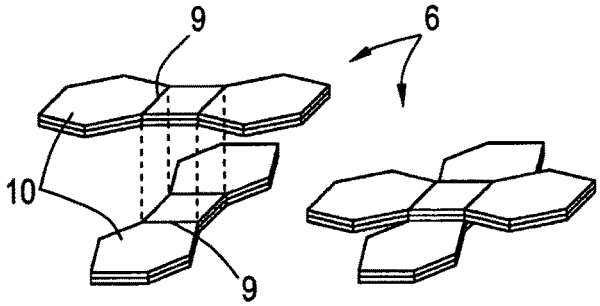
FIGS. 4 and 5 show examples of layers wherein the orientation of the material varies from lobe to lobe.
Figure 5:
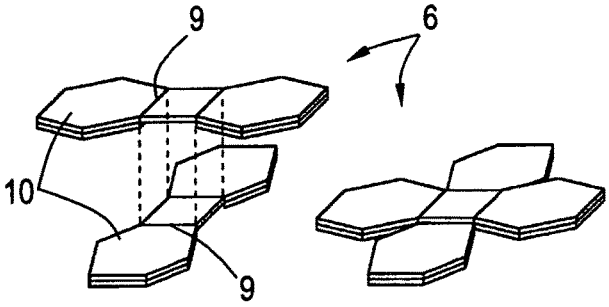
Figure 6:
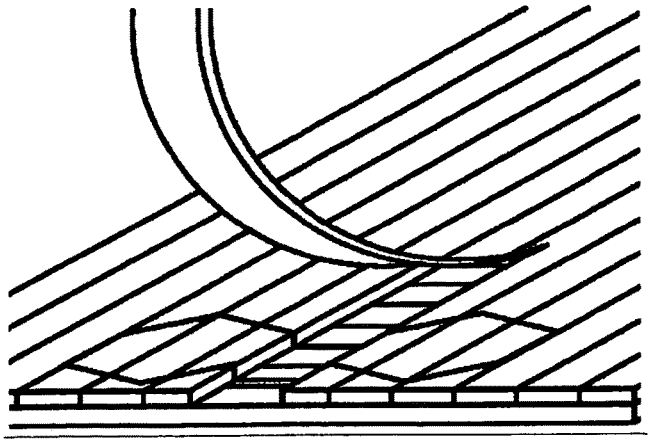
FIG. 6 shows a method of making a layer as shown in FIG. 5.

In the example shown in FIGS. 1 to 3, patterns are cut as a whole from a single cross-ply. In two dimensions (flat), the tape orientation in the top and bottom plies is consistent over the entire layer. In three dimensions (shell), the tape orientation in the 0-90° cross-plies reverses in the lobes that fold parallel to the tape orientation in the top ply. I.e., when the tape orientation in the front and rear lobes is 0-90°, the tape orientation of the side lobes is 90-0°. This in turn implies that upon rotating the layers over an angle $\alpha 2$ the tape orientation in the stack gradually reverses. Though distributed evenly throughout the stack, the overlapping zones of different lobes in successive layers possess a non-ideal continuation of tape orientation: the overlapping zones exhibit a transition from 0-90° to 60-150°, i.e. 90-60° between layers. In the configurations according to the present embodiments, these zones are inherently small and thus the effect of these zones is small. However, to further optimize ballistic performance of the article according to the present embodiment, orientation in the lobes is preferably decoupled. FIG. 4 shows decoupling of the orientation of the lobes in pairs, by two identical two dimensional patterns that, once cross-stacked)(0-90°, yield a transition in the overlapping zones from 0-90° to 30-120°, with 90-30°, i.e. 0-60° between layers, which is a marked improvement over 0-30°. FIG. 5 shows an embodiment wherein such decoupling is prevented from resulting in twice the amount of layers in the crown (stack of central polygons) of the helmet (as shown in FIG. 4), providing an even material distribution and thus pressure distribution in the mould. Due to the low matrix content and the easy, geometrically well controlled and continuous slit-ability of tape, the top or bottom layer of the cross-ply can be selectively removed for the central polygon, as shown in FIG. 6. After cross-stacking and adhering the decoupled patterns by mild temperatures to soften the matrix, even material distribution is obtained on the entire spherical surface, as shown in FIG. 5.

The example according to the embodiment is denoted as concept A and compared to other concepts B, C and D.

The helmet shell following concept B comprises a stack of identical rosettes, cut from a crossply of high-strength polyethylene monolayers, e.g. Endumax®, and rotated over a constant angle of 22.5°.

While the example of the embodiment is based on squares and hexagons that are after rotation continuously corrected for their position on the surface and in the stack, the spherical surface of concept C is described by triangles and octahedrons and not corrected for its positioning on the spherical surface. As a consequence the ply cannot be fully rotated (at a multiplication of 360°) without introduction of irregularities such as wrinkling. Hence the incisions were distributed by rotations within an maximum angle of 90°.

The helmet shell according to concept D is made by "thermoforming" a pre-consolidated stack of Endumax® cross-plies in which the tape orientation in the successive cross-plies is identical throughout all layers.

All helmet shells are compressed under identical conditions and evaluated ballistically according to Stanag 2920 testing. The ballistic performance is expressed by the specific energy absorption ($SEA_{50}$), which is defined by $$0.5\times M_{projectile}\times V_{50}^2/\mathrm{AW}$$

in which $M_{projectile}$ is the mass of the projectile in kilogram and $V_{50}$ is the determined velocity in meter per second where the perforation probability of the respective projectiles is 50%. The areal weight AW is expressed in kilogram per square meter. It is evident that concept A according to the invention offers homogenous performance and a relatively high $SEA_{50}$.

Figure 7:
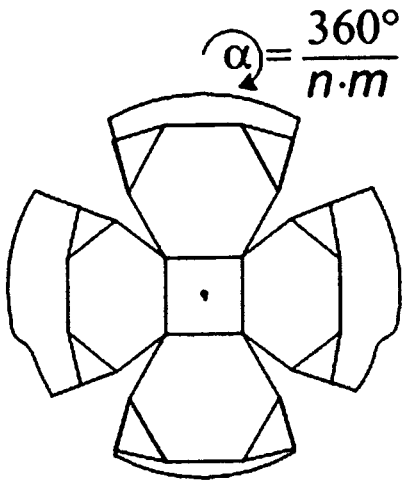
FIGS. 7 and 8 depict concept A described herein.
Figure 8:
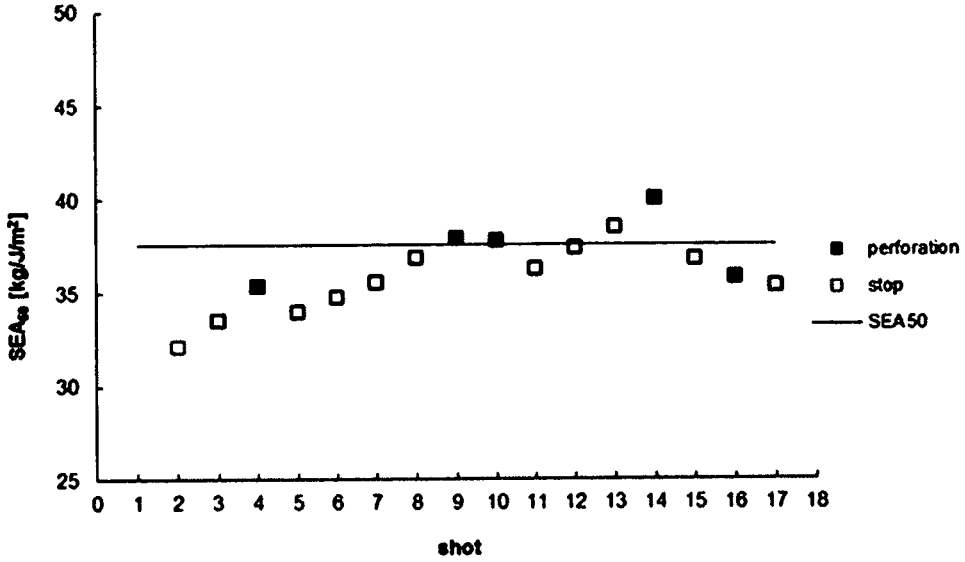

FIG. 7 and FIG. 8 concept A: Homogeneous performance by even distribution of incisions and small rotation angles in material orientation of successive layers. Continuous rotation over 2.25°, $SEA_{50}$=38 J/kg/m$^2$.

Figure 9:
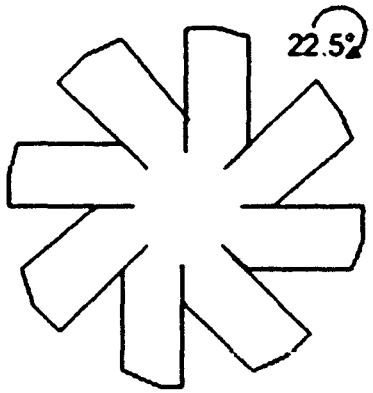
FIGS. 9 and 10 depict concept B described herein.
Figure 10:
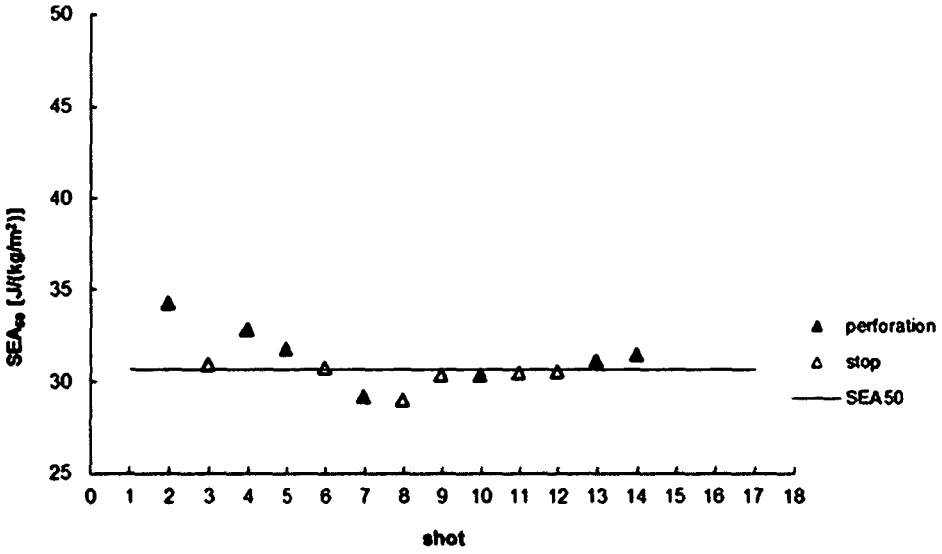

FIGS. 9 and 10 Concept B: Homogeneous performance by distribution of the incisions and large rotation angles in material orientation of successive layers. Continuous rotation over 22.5°, $SEA_{50}$=31 J/kg/m$^2$.

Figure 11:
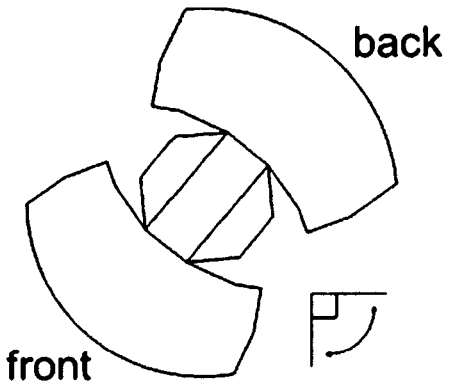
FIGS. 11 and 12 depict concept C described herein.
Figure 12:
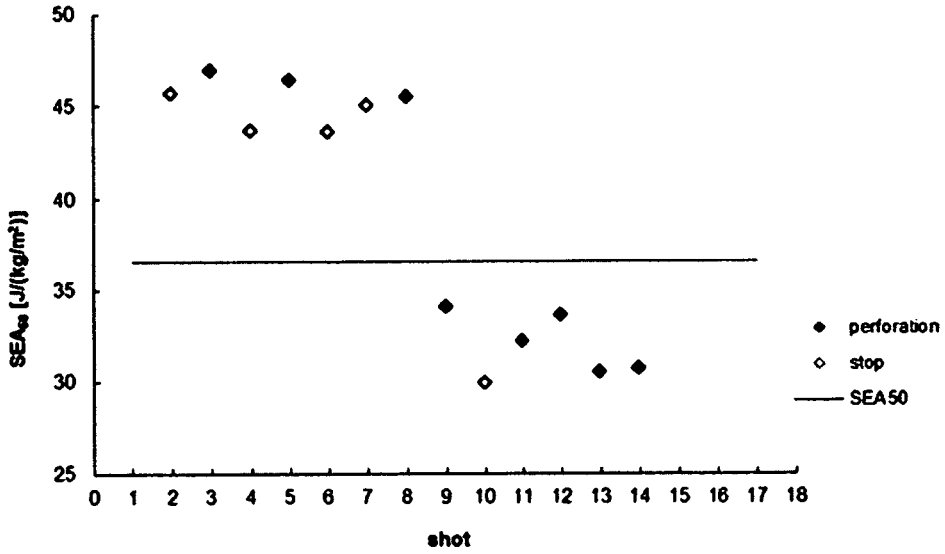

FIGS. 11 and 12 Concept C: Inhomogeneous performance by accumulation of incisions in sides(9-14) and small rotation angles in material orientation of successive layers in front and back(2-8). Distributed syst. over 90°, $SEA_{50}$=37 J/kg/m$^2$.

Figures 13, 14:
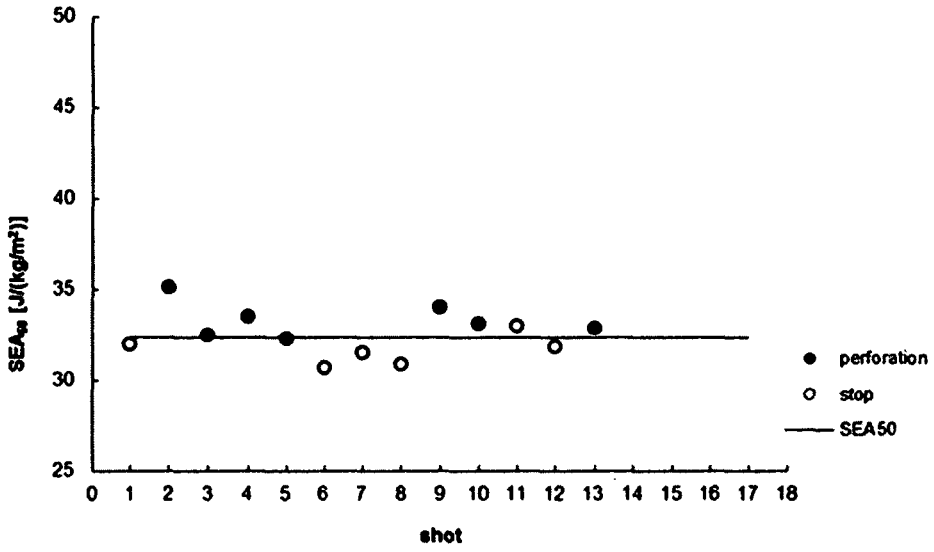
FIGS. 13 and 14 depict concept D described herein.

FIGS. 13 and 14 Concept D: Uncontrollable wrinkling leads to unnecessary low performance despite the absence of incisions and maximum preservation of 0-90° tape orientation in successive layers. $SEA_{50}$=32 J/kg/m$^2$.

As a matter of course, the invention is not restricted to the above-disclosed embodiment and can be varied in numerous ways within the scope of the claims.

The invention claimed is:

1. A ballistic resistant article comprising:

a double curved shell comprising a stack of layers, wherein each layer of the stack comprises one or more plies of an oriented anti-ballistic material in the form of oriented fibers or oriented tapes, the layers having a plurality of cuts, wherein ends of the cuts define a central polygon and lobes extending from the polygon, wherein the stack comprises at least 10 rotationally staggered layers, wherein each two successive layers of the at least 10 rotationally staggered layers are rotated by an angle (α2) with respect to each other such that each of the at least 10 rotationally staggered layers are at a corresponding number of different rotational positions, and wherein the orientation of the fibers or tapes in the one or more plies is rotationally staggered relative to the orientation of the fibers or tapes in the one or more plies of a successive layer over an angle (α1) of 90°±30°.

2. The ballistic resistant article according to claim 1, wherein the stack comprises at least 20 layers.

3. The ballistic resistant article according to claim 1, wherein the layers have a thickness in a range from 10 to 300 microns.

4. The ballistic resistant article according to claim 1, wherein the orientation of the material relative to a pattern of the layers is substantially identical in all layers.

5. The ballistic resistant article according to claim 1, wherein the orientation of the material relative to a pattern of the layers varies in all layers.

6. The ballistic resistant article according to claim 1, wherein the polygon is defined by four cuts in the layers.

7. The ballistic resistant article according to claim 6, wherein all of the layers comprise four lobes and the orientations of the material in neighboring lobes, when considered in a two dimensional state of the layer, are rotated relative to each other.

8. The ballistic resistant article according to claim 1, wherein the article is ellipsoidal, and the shape of all layers is adapted for a position of the respective layer over the ellipsoidal shell surface and a position of the respective layer in the stack.

9. The ballistic resistant article according to claim 1, wherein each of the layers comprises one of a ply of unidirectional polymer tapes, a ply of unidirectional polymer sheets, two plies of unidirectional polymer tapes cross-plied, two plies of unidirectional polymer sheets cross-plied, a fabric of unidirectional polymer tapes, and a fabric of unidirectional polymer sheets.

10. The ballistic resistant article according to claim 1, wherein for at least 80% of the successive layers, the orientation of the material in the one or more plies is rotationally staggered relative to the orientation of the material in the one or more plies of a successive layer.

11. The ballistic resistant article according to claim 1, wherein, in a region where a lobe in one layer overlaps a cut and a small portion of a lobe in an adjacent layer, a matrix is applied between the adjacent lobes.

12. A semi-finished product for making a shell, wherein the semi-finished product comprises:

a stack of layers, wherein each layer of the stack comprises one or more plies of an oriented anti-ballistic material in the form of oriented fibers or oriented tapes, the layers having a plurality of cuts, wherein ends of the cuts define a central polygon and lobes extending from the polygon, wherein the stack comprises at least 10 rotationally staggered layers, wherein each two successive layers of the at least 10 rotationally staggered layers are rotated by an angle (α2) with respect to each other such that each of the at least 10 rotationally staggered layers are at a corresponding number of different rotational positions, and, and wherein, the orientation of the fibers or tapes in the one or more plies is rotationally staggered relative to the orientation of the fibers or tapes in the one or more plies of a successive layer over an angle (α1) of 90°±30°.

13. The semi-finished product according to claim 12, wherein the stack of layers is held together and rotationally fixed by one or more fastening means extending through the central polygons.

14. A method of manufacturing a double curved ballistic resistant object, comprising:

placing a stack of layers, wherein each layer of the stack comprises one or more plies of an oriented anti-ballistic material in the form of oriented fibers or oriented tapes, in a concave mold, and consolidating the stack by applying elevated temperature and pressure, wherein the layers have a plurality of cuts, wherein ends of the cuts define a central polygon and lobes extending from the polygon, wherein the stack comprises at least 10 rotationally staggered layers, wherein each two successive layers of the at least 10 rotationally staggered layers are rotated by an angle ($\alpha 2$) with respect to each other such that each of the at least 10 rotationally staggered layers are at a corresponding number of different rotational positions, and wherein the orientation of the fibers or tapes in the one or more plies is rotationally staggered relative to the orientation of the fibers or tapes in the one or more plies of a successive layer over an angle ($\alpha 1$) of 90°±30°.

15. The ballistic resistant article according to claim 1, wherein the angle ($\alpha 2$) between the layers is $((P\times 360°)/(N\times M))\pm 20\%$, wherein P is an integer, N is the number of layers, and M is the number of cuts.

16. The ballistic resistant article according to claim 15, wherein the angle ($\alpha 2$) between the layers is smaller than 20°.

17. The ballistic resistant article according to claim 15, wherein P equals 1, 2, 3 or 4.

18. The ballistic resistant article according to claim 1, wherein the first layer, the second layer and the third layer are each rotationally staggered in a same rotational direction.

* * * * *